US006772480B2

(12) United States Patent
Prevot et al.

(10) Patent No.: US 6,772,480 B2
(45) Date of Patent: Aug. 10, 2004

(54) FITTING HAVING SUPPORT ARM OR SWING ARM FOR SUPPORTING A TURNING SASH OR A TURNING-TILTING SASH

(75) Inventors: Gérard Prevot, Willerwald (FR); Sylvain Klespert, Sarrebourg (FR)

(73) Assignee: Ferco International Ferrures et Serrures de Batiment, Reding (FR)

( * ) Notice: Subject to any disclaimer, the term of this patent is extended or adjusted under 35 U.S.C. 154(b) by 103 days.

(21) Appl. No.: 09/827,996

(22) Filed: Apr. 6, 2001

(65) Prior Publication Data

US 2002/0023396 A1 Feb. 28, 2002

Related U.S. Application Data

(63) Continuation of application No. 09/426,569, filed on Oct. 22, 1999, now Pat. No. 6,286,262, which is a continuation of application No. PCT/EP98/02346, filed on Apr. 21, 1998.

(30) Foreign Application Priority Data

Apr. 23, 1997 (DE) ..... 297 07 358 U

(51) Int. Cl.[7] ..... E05D 7/00; E05C 7/04

(52) U.S. Cl. ..... 16/257; 16/384; 49/366; 49/399

(58) Field of Search ..... 49/371, 366, 142, 49/388, 399, 400; 52/204.51, 207; 16/382, 384

(56) References Cited

U.S. PATENT DOCUMENTS 1,417,758 A * 5/1922 McLaughlin ..... 16/384
3,591,247 A * 7/1971 Berry et al. ..... 16/382
5,870,801 A * 2/1999 Kim ..... 16/382
5,960,518 A * 10/1999 Jeong ..... 16/382

FOREIGN PATENT DOCUMENTS

| | | | |
|---|---|---|---|
| DE | 3223625 | * 12/1983 | |
| DE | 3702957 | * 1/1987 | |
| DE | 8911966 | * 11/1989 | |
| DE | 93 08 671 | * 10/1994 | ..... 49/371 |
| DE | 4403524 | * 8/1995 | |
| EP | 0 421 904 | * 4/1991 | ..... 49/371 |
| EP | 460422 | * 12/1991 | |

* cited by examiner

*Primary Examiner*—Michael Safavi
(74) *Attorney, Agent, or Firm*—Kenyon & Kenyon

(57) ABSTRACT

A window sash (3) is mounted on a stationary frame (2) so as to be only rotatable about a horizontal axis but not tiltable using a lower corner bearing (5) such as is also used for turning-tilting fittings, and using an upper hinge bearing (9), which is connected to the sash via a support arm (11). The support arm (11) is sufficiently flexible in the vertical direction in order to be able to follow the vertical adjustment movements of the sash which are carried out at the corner bearing (5). Using a guide part (29*a*) engaging in the rabbet groove of the sash (3), the support arm (11) is guided vertically and is supported against motions perpendicular to the sash plane. For the left-right repositioning of the fitting, the support arm (11) is connected to the hinge bearing (9) by a turning bearing (69) turning about a horizontal axis, the turning bearing being configured in its radial direction so as to have spring elasticity, in order to be able to engage and disengage a locking projection (77,78) with the assigned locking recesses (75,76).

3 Claims, 8 Drawing Sheets

Figure 1:
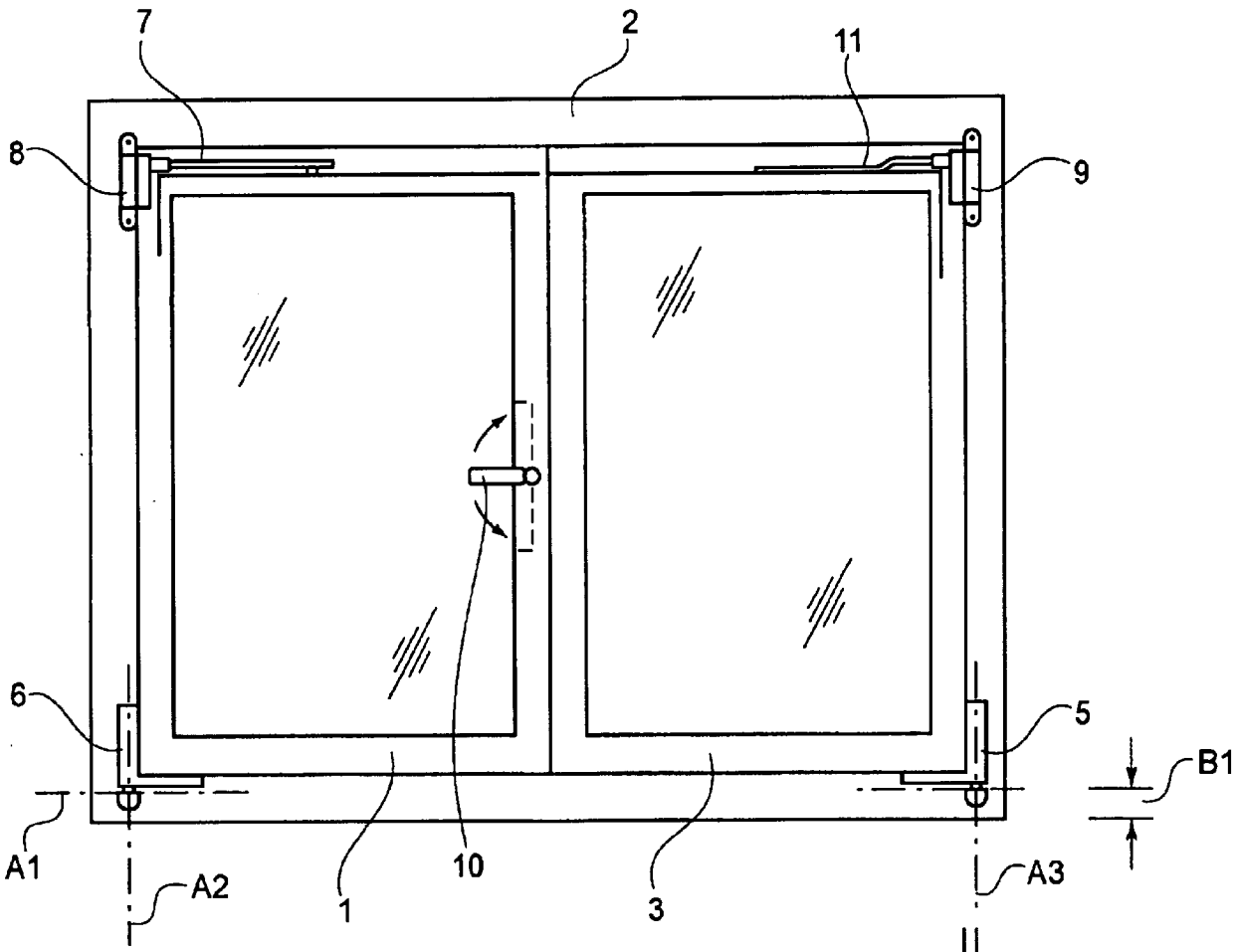

37
31
35
65
69
51
63
53
73
71
61
29
29a
58
77
67
41
9
43
45
39
27a
61a
57
59
27
13
16
11
25
15
23
120
69a
69c
69b

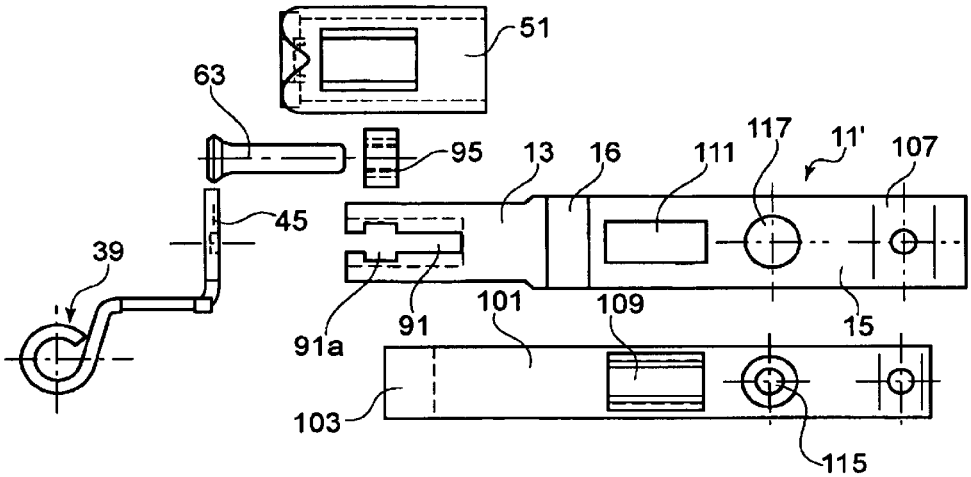
FIG. 17
FIG. 18
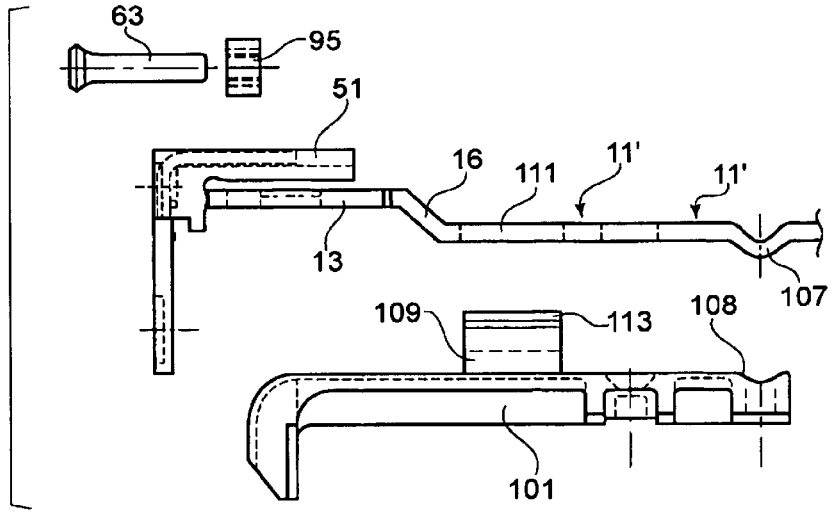

FITTING HAVING SUPPORT ARM OR SWING ARM FOR SUPPORTING A TURNING SASH OR A TURNING-TILTING SASH

This application is continuation of a Ser. No. 09/426,569 filed Oct. 22, 1998, now U.S. Pat. No. 6,286,262 which is a continuation of International Application PCT/EP98/02346 filed on Apr. 21, 1998, which are incorporated herein by reference.

The invention concerns a fitting having a support arm or a swing arm for supporting a turning sash and or a turning-tilting sash of a window, a door, or the like.

A fitting of this type having a swing arm for supporting a turning-tilting sash is known, for example, from European Patent 0 421 904 B1. It is composed of a hinged bearing to be secured on the frame, a swing arm connected to the sash so as to be able to pivot and to be latched, and a bearing bracket connecting the swing arm to the hinged bearing, the horizontal leg of the bearing bracket forming a guideway having an adjusting device for the end of the swing arm. The adjusting device makes it possible to adjust the effective length of the swing arm, in order, for example, to be able to straighten a sagging window sash. In order to be able to reposition the fitting to a right or left limit stop, the bearing bracket is mounted on the hinged bearing so as to turn about a horizontal axis, and it can be fixed in two turning positions, 180° apart, assisted by projections and recesses that interact together. For engaging and disengaging these projections and recesses, provision is made for a cam, to be turned using a tool. A fitting of this type having a swing arm is used for supporting a turning-tilting sash together with a corner bearing provided on the lower corner of the sash, the corner bearing essentially accepting the weight of the sash and making possible the turning movements about the vertical axis as well as the tilting movements about the horizontal axis.

Usually supported in conventional hinge joints are turning sashes that can only be turned about a vertical turning axis but cannot be tilted. But it is also known to modify the design for fittings for turning-tilting windows so that they can also be used for supporting turning sashes. This has essentially two advantages. First, the number of different fitting parts to be manufactured and stored is reduced if the same fitting parts can be used for supporting either a turning-tilting sash or a turning sash. Second, it is advantageous in two-sash windows having one turning-tilting sash and one turning sash if both sashes can be supported using identically shaped fitting parts supported at the same location, so that a symmetrical appearance results.

It is therefore known to adapt a fitting having a swing arm, such as in European Patent 0 421 904 B1, for the supporting of a turning sash such that the swing arm is replaced by a so-called "false shears arm," i.e., a support arm, which is rigidly connected to the turning sash at the latter's upper horizontal rabbet surface. In one example known from practice, the support arm running in the upper horizontal rabbet space of the sash above the rabbet surface is screwed to a cuff (locking) bar secured in the rabbet surface groove at a plurality of locations, the cuff bar being additionally anchored on the sash by footings extending to the base of the rabbet surface groove to improve stability.

In adapting a fitting having a swing arm, provided for a turning-tilting sash, for the supporting of a turning sash, various problems and goal concepts arise. One of these problems concerns the possibility normally present in turning-tilting sashes of vertically adjusting the sash relative to the frame. For this purpose, the lower corner bearing is configured so as to be vertically adjustable. The swing arm of the turning-tilting fitting can follow such vertical adjustment motions because there is sufficient bearing play in the hinge pins connecting it to the cuff bar of the sash. In a turning sash, which is supported not with a swing arm but with a support arm that is to be rigidly attached to the sash, this bearing play is absent and with it the adjustability. Therefore, it would be desirable to configure the support arm so that it permits vertical adjustment movements also in a turning sash without the stability of the connection between support arm and sash being impaired, in particular for accommodating the forces acting perpendicular to the sash plane.

The task therefore arises to configure both the support arm as well as the parts connecting it to the frame-side hinge bearing so that the bearing-side end of the support arm has sufficient vertical freedom of motion relative to the sash frame for the purposes of adjustment, while at the same time being sufficiently supported and guided at the sash in order to be able to accommodate all the force components acting in the horizontal direction including those transverse to the sash plane. In this context, the further requirement arises that the elements functioning as guidance and support of the support arm must be configured so that they do not impair the use of the same fitting for the supporting of a turning-tilting sash, where the support arm is exchanged for a swing arm.

Furthermore, the fitting is to be simplified with respect to its manufacture and use. For a rational production process, the fitting should be configured so that to the greatest extent possible all parts can be manufactured exclusively using bending, stamping, and pressing processes, and that no parts are required to be made separately by casting. The simplification with respect to operation is first and foremost to relate to the right-left repositioning of the fitting. This is accomplished in the case of the known fitting according to European Patent 0 421 904 B1 by activating a cam, for which a tool, e.g., a wrench for socket head screws, is required. The fitting according to the invention is to be able to be repositioned without the assistance of a tool but also without impairing the reliability and stability of its being fixed in the one or the other position.

For achieving the stated objectives, the invention provides for a fitting as illustrated and described.

With the fitting according to the invention, a swing arm for supporting a turning-tilting sash or, alternatively, a support arm for supporting a turning sash can be employed, the support arm being flexible to the extent that it can follow the vertical adjustment movements of the sash relative to the frame in the same way that this is possible with a swing arm, due to the bearing play in the pivot pins. However, the stability and load-bearing capacity of the connection of the support arm to the sash is assured due to the fact that additional guiding means are provided which engage the rabbet groove of the sash, the guiding means guiding the support arm in the vertical direction. These guiding means, in this context, are configured so that they are present only together with the support arm and are omitted if, in place of a support arm, a swing arm is used for a turning-tilting sash. In this case, the rabbet surface groove is free of guiding parts engaging in it and can, as is necessary in a turning-tilting sash, accept a corner guide piece of a connecting rod, for example, for locking or releasing the swing arm.

Further features of the invention and their significance for the stated tasks and goals of the invention are yielded from the following description of the exemplary embodiments of the invention.

DEPICTED IN THE DRAWINGS ARE

Figure 2:
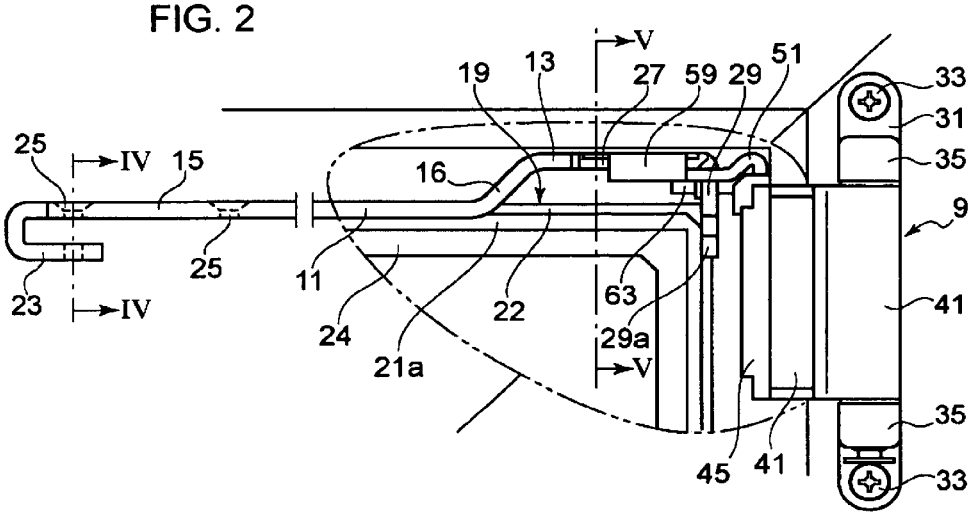
Figure 3:
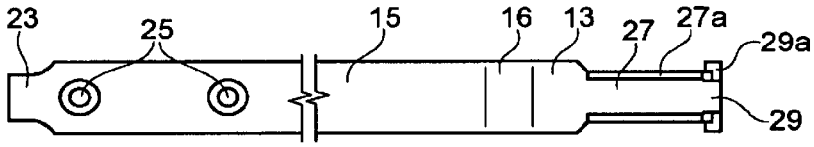
Figure 4:
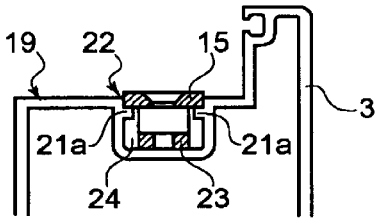
Figure 5:
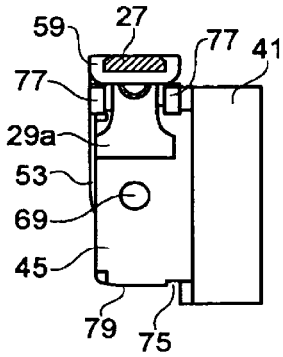
Figures 6, 8A, 8B:
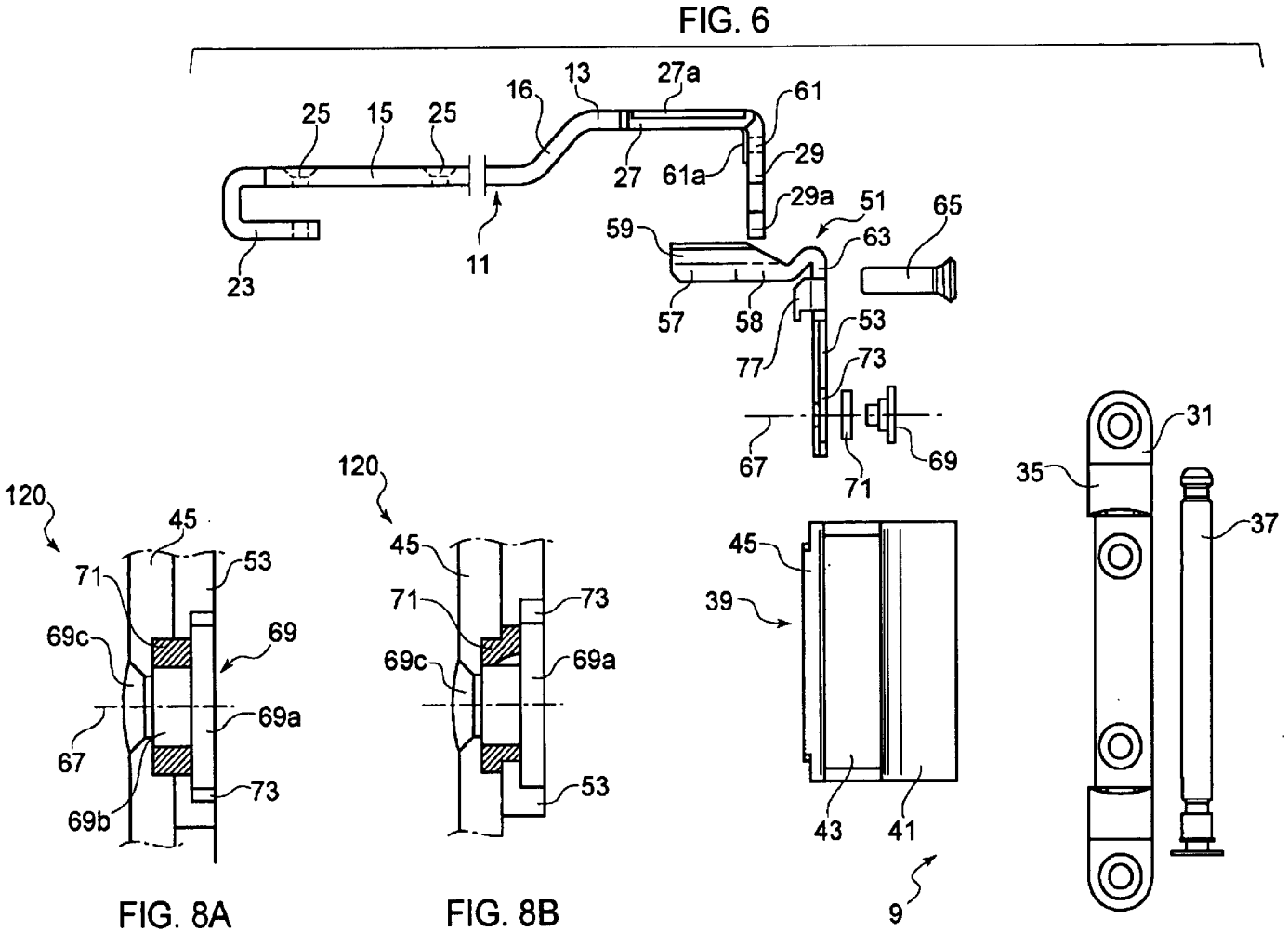
Figures 7, 14:
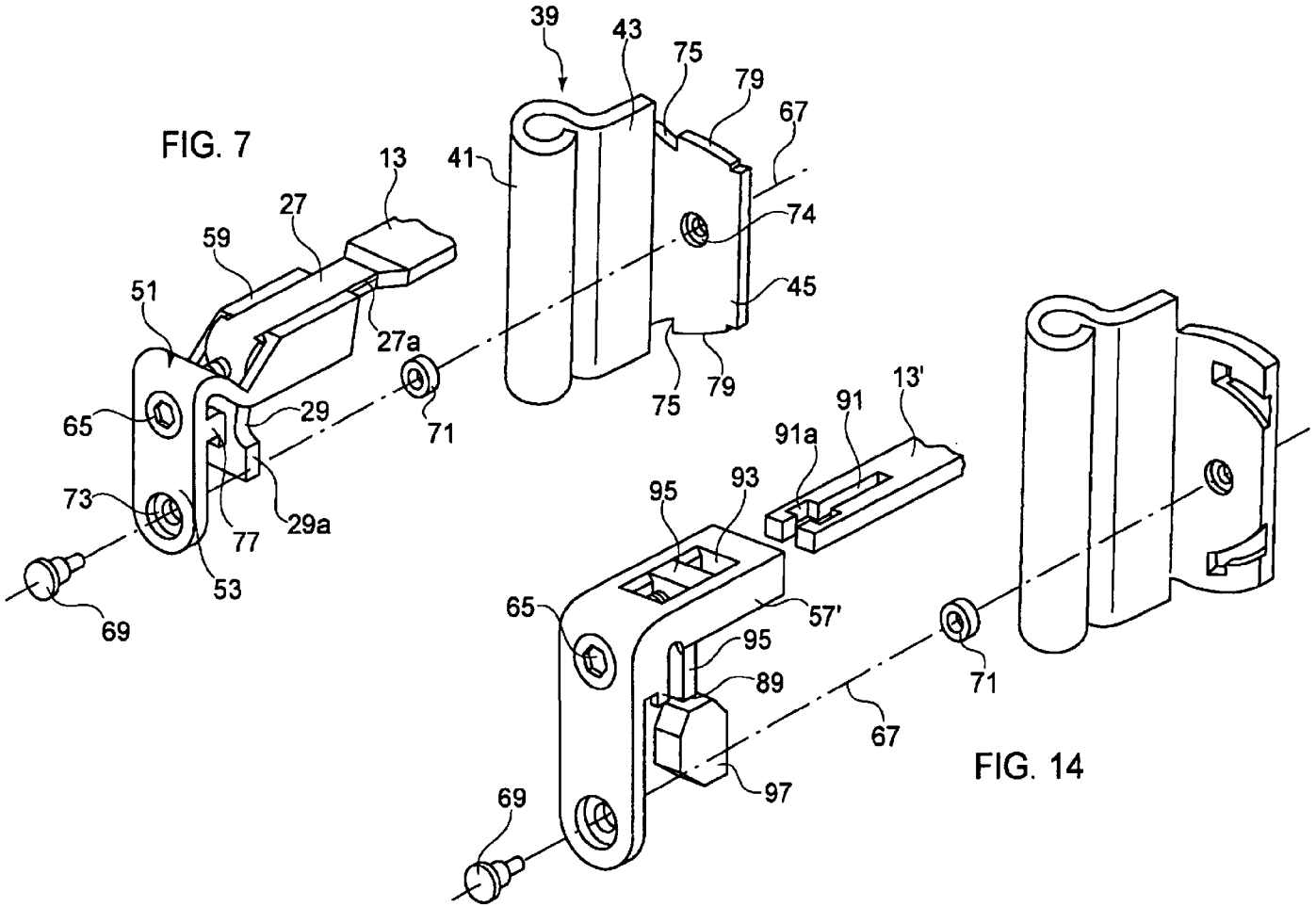
Figure 9:
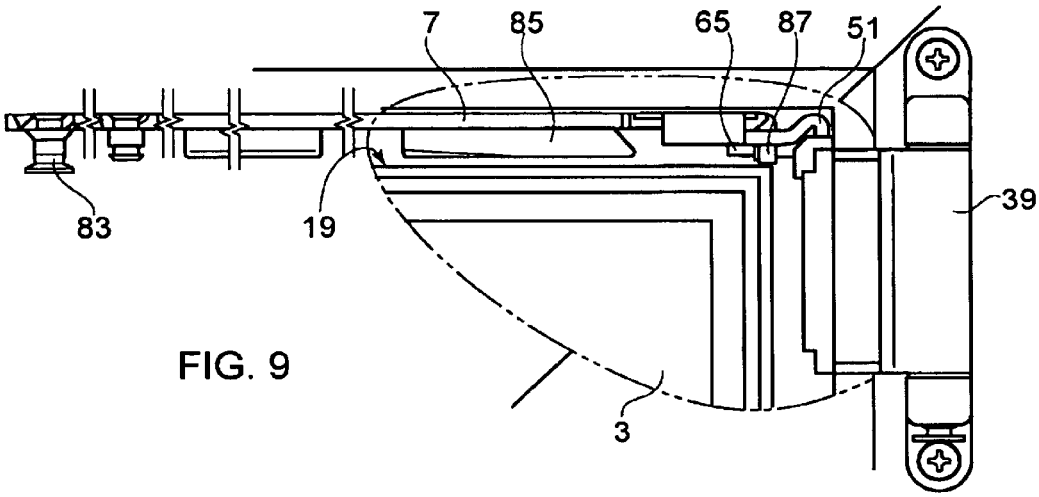
Figure 10:
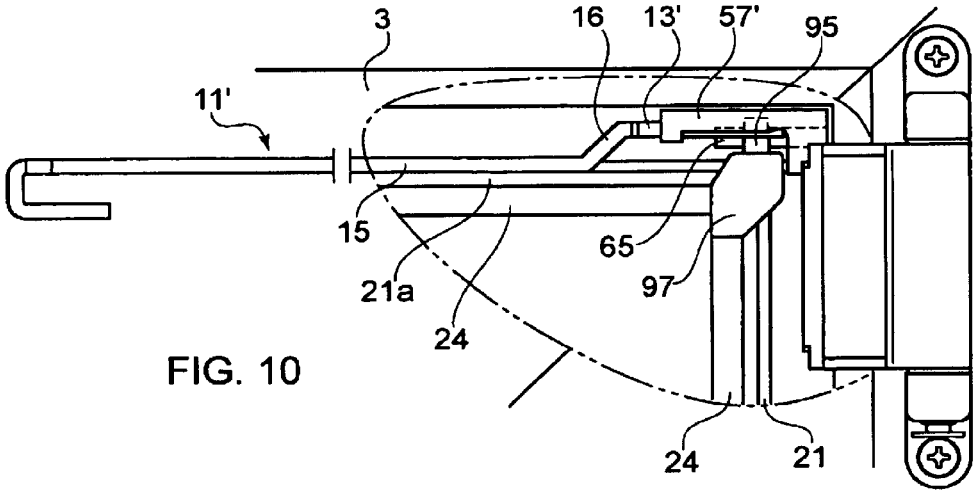
Figure 11:
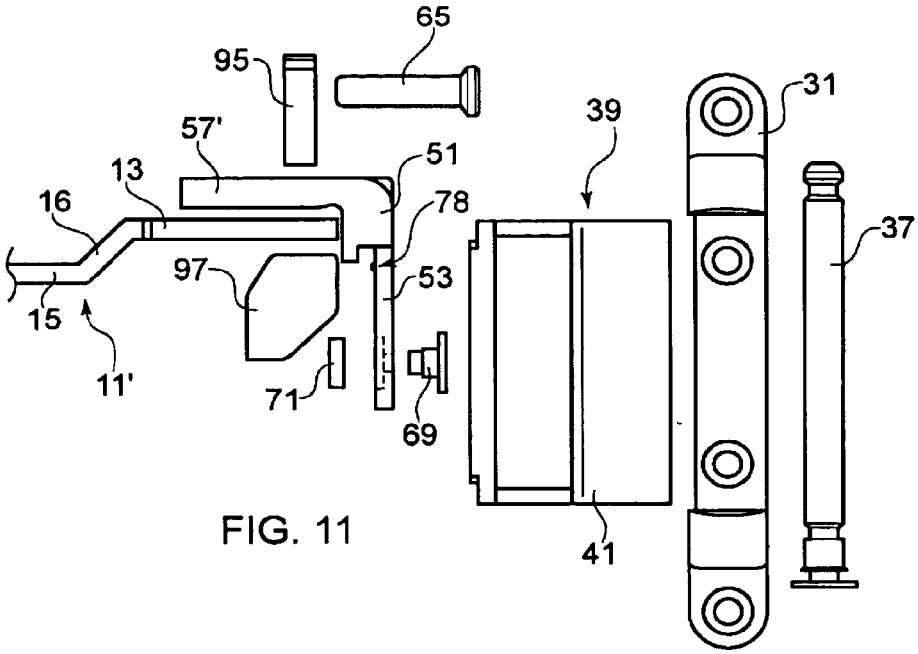
Figure 13:
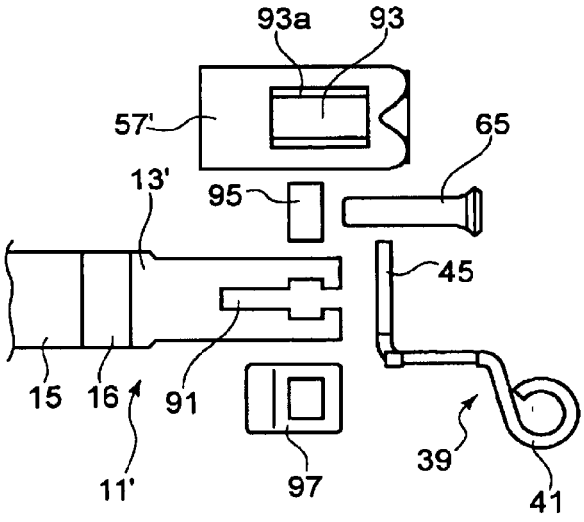
Figure 12:
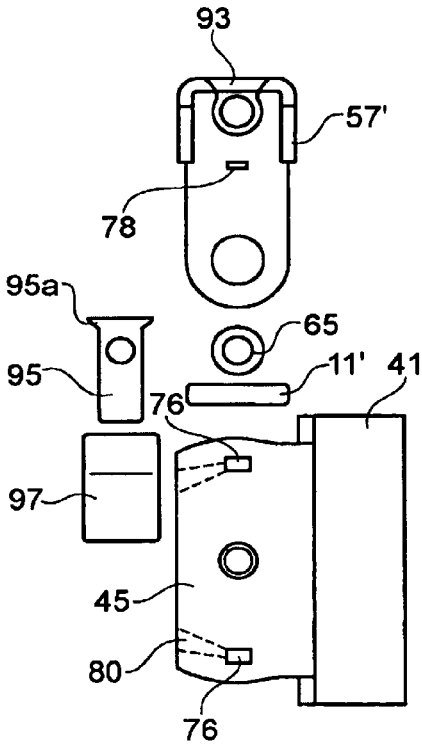
Figure 15:
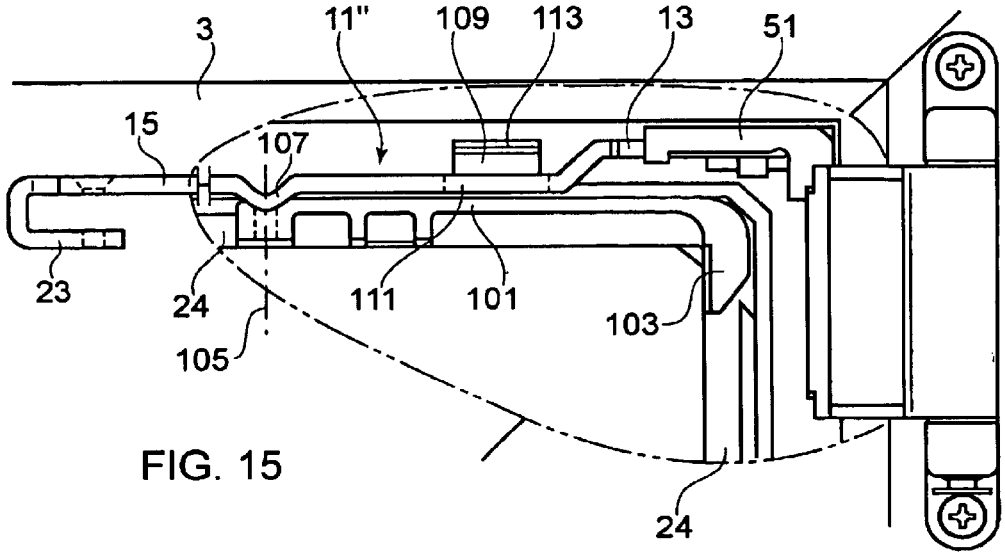
Figure 16:
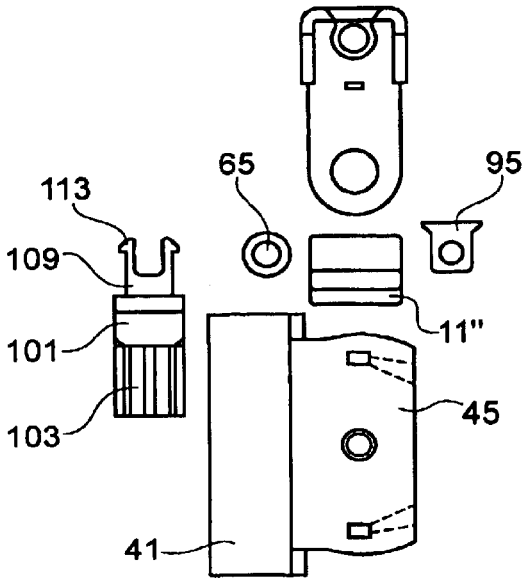

FIG. 1 a two-sash window furnished with the fitting according to the invention;

FIG. 2 a first specific embodiment of the fitting in a side view;

FIG. 3 a top view of the support arm;

FIG. 4 a cross-section along line IV—IV in FIG. 2 of the support arm, along with the sash frame depicted in the cross-section;

FIG. 5 a view of the fitting, partly in cross-section along line V—V of FIG. 2;

FIG. 6 a combined view of the individual parts of the fitting in accordance with FIG. 2;

FIG. 7 a perspective depiction of parts of the fitting according to FIG. 2;

FIG. 8A and FIG. 8B a cross-section of the turning bearing of the fitting for the right-left repositioning;

FIG. 9 a side view of the fitting similar to FIG. 2, the support arm, however, being replaced by a swing arm;

FIG. 10 a second specific embodiment of the fitting in a similar depiction as in FIG. 1;

FIGS. 11, 12, and 13 individual combined views of the individual parts of the fitting in a side view, a front view, and a top view;

FIG. 14 a perspective depiction of the second specific embodiment;

FIG. 15 a third specific embodiment in a side view of the fitting according to the invention;

FIGS. 16, 17, and 18 combined views of the individual parts of the fitting according to FIG. 15 in a front view, top view, and side view.

In the two-sash window depicted in FIG. 1, left sash 1 is a turning-tilting sash and right sash 3 is a turning sash. Turning-tilting sash 1 is supported in the usual fashion by lower turning-tilting corner bearing 6 and upper swing shears 7 having shears bearing 8 and, for the purposes of latching and opening, it has a conventional connecting rod mechanism (not depicted), which can be actuated by a handle 10. The handle can be moved into three positions, corresponding to the closed position, the tilt opening for tilting about horizontal tilt axis A1, and the turn opening for turning about vertical turn axis A2. The swing shears have a swing arm 7 secured to the pivoting part of hinge bearing 8. Swing arm 7 is hidden in the horizontal rabbet space of turning-tilting sash 1, having clearance above the upper rabbet surface and it can be rigidly latched to the sash-side fitting using latching elements which are actuated using handle 10, or it can be released for the sake of a pivoting motion for the tilt opening.

Turning sash 3 can only be turned about a vertical turn axis A3. However, it is also supported on the frame using a lower corner bearing 5 in combination with an upper hinge bearing 9 and a support arm 11 (also called "false shears arm"). Corner bearing 5 of turning sash 3 can be a turning-tilting corner bearing of the same type as corner bearing 6 of turning-tilting sash 1, so that for both sashes only one type of corner bearing has to be manufactured and stored. Alternatively, corner bearing 5 of the turning sash can also be a pure turning bearing, able to turn only about the vertical axis A3.

In corner bearings 5, 6 provision is made in a generally known manner for the possibility of vertical and horizontal adjustment, in order to be able to adjust the sash relative to the frame. The adjustment ranges are indicated with B1 and B2 and can amount in each case to several millimeters.

Upper hinge bearing 9 of turning sash 3 is of the same design as shears bearing 8 of turning-tilting sash 1. The upper hinge bearing 9 is configured according to the invention such that either a swing arm 7 for a turning-tilting sash or a support arm 7 for a turning sash can be attached to it.

A first specific embodiment of swing arm 11 and its connection to hinge bearing 9 is depicted in FIGS. 2 through 8. Support arm 11 has a bearing-side segment 13 and a sash-side segment 15, which are connected to each other by a bent segment 16, so that they lie in different planes. Support arm 11, in the specific embodiment depicted, is designed for use with a sash frame 3, whose rabbet surface 19 has a rabbet surface groove, which, as is depicted in FIG. 4, has two ribs 21*a* projecting to the inside, which subdivide the groove into an upper groove part 22 for accommodating a cuff bar (if it is present) and a lower groove part 24 for accommodating a connecting rod. Sash-side segment 15 of support arm 11 is configured so that it fits into cuff bar groove 22 and then is roughly flush with rabbet surface 19 of sash frame 3, as is depicted in cross-section in FIG. 4. At its end sash-side segment 15 is bent in a U-shape, and bent part 23 has a smaller width, the width and depth of this U-shaped bent part 23 being so dimensioned that it can engage between ribs 21*a* into lower groove part 24 and can make contact with the base of the connecting rod. Using fastening bolts (not depicted), which are screwed through feed-through openings 25 of support arm 11 into sash frame 3, sash-side segment 15 of support arm 11 is rigidly attached to the sash. Sash-side segment 15 preferably extends across approximately 75–80% of entire length of support arm 11. Sash frame 3 is depicted in FIG. 4, by way of example, as a plastic frame, but the fitting according to the present invention can, of course, also be mounted on wooden, aluminum, and composite frames.

Bearing-side segment 13 of support arm 11, across one portion of this length, forms a guiding segment 27 having reduced width. Connected to it is a leg 29, bent at a right angle downwards, which at its lower end 29*a* expands to the same width as sash-side segment 15 of support arm 11, i.e., having a width corresponding to the width of cuff bar groove 22 of the sash frame.

Hinge bearing 9 has a fixed bearing part 31, which can be secured to window frame 3 using screws 33 and two protruding bearing lugs 35 for accommodating a vertical axle bolt 37. A movable bearing part 39 is mounted on fixed bearing part 31, the movable bearing part being composed of a bearing sleeve 41, which surrounds axle bolt 37 and, via a connecting segment 43, is connected to a bearing plate 45 (FIG. 5), which is bent backwards at a right angle (in FIG. 2 and FIG. 6).

Support arm 11 is connected to movable bearing part 39 of hinge bearing 9 via a bearing bracket 51, whose vertical leg 53 grips bearing plate 45 of movable bearing part 39 from behind and is secured there in a manner yet to be explained. Horizontal leg 57 of bearing bracket 51 forms a U-shaped guideway 59, open upwards, in which guide segment 27 of support arm 11 is supported so as to be movable in the longitudinal direction. Bordering on U-guideway 59, horizontal leg 57 of bearing bracket 51 has an opening 58, through which extends leg 29 of support arm 11, bent at a right angle. In this leg 29 a tapped bore hole 61 is introduced, which, when support arm 11 is inserted into bearing bracket 51, aligns with a feed-through opening 63 in vertical leg 53 of bearing bracket 51. An adjustment screw 65 can be screwed through feed-through opening 63 into tapped bore hole 61 of support arm 11 and functions to adjust support arm 11 relative to bearing bracket 51 and therefore relative to hinge bearing 9. In this manner, sash frame 3 can be adjusted relative to window frame 1 in the horizontal direction, for example, to adjust a sagging sash frame.

Guide segment 27 of support arm 11 has at its upper edge slanted surfaces 27*a* that are beveled prism-like. The latter, as can be seen in FIG. 5, are overlapped by the upper edges of U-guideway 59, that are pressed inwards, so that support arm 11 is undetachably secured in the U-guideway 59 of bearing bracket 51. Tapped bore hole 61 can be provided with a thread in advance. However, it is preferably a question of a simple bore hole, into which the thread is cut using adjustment screw 65 that is configured as a self-tapping screw.

Support arm 11 is shaped form flattened wire material exclusively through bending, pressing, and stamping processing. For bending vertical leg 29, care can be taken by using a suitable die that a thickening of the material 61*a* forms on the inner side, to increase the length of the bore hole in which adjustment screw 65 is set. In addition, bearing bracket 51 is so configured that it can be manufactured from planar material exclusively using bending, stamping, and pressing processes.

As already mentioned, lower corner bearing 5 of turning sash 3 provides for the possibility of a vertical adjustment in the adjustment range B1 indicated in FIG. 1. In order to be able to follow this adjustment, provision must be made also in the area of upper hinge bearing 9 and support arm 11 for corresponding vertical play. No vertical perpendicular play is provided in hinge bearing 9. The gaps seemingly depicted in FIG. 2 between the bearing sleeve 41 and bearing lugs 35 are in practice filled using friction-reducing shim rings made of brass or plastic. Therefore, provision is made according to the present invention in support arm 11 for the play necessary for the vertical adjustment, specifically as a result of the flexibility of support arm 11, which is given above all in the area of bend 16 as well as between the latter and the closest attachment location on the sash frame. As a result, bearing-side segment 13 can move in the vertical direction relative to the part of sash-side segment 15 that is fixedly secured on the sash to the extent that it can follow the adjustment movements. End 29*a* of bracket 29, bent at a right angle, is movably supported in vertical rabbet groove 22 of sash frame 3, so that bearing-side segment 13 of support arm 11 is sufficiently supported and secured on the sash frame against forces acting perpendicular to the sash plane, without its movements being hindered in the vertical direction.

In what follows, the attachment of bearing bracket 51 to bearing plate 45 of movable bearing part 39 will be described, reference being made to FIGS. 6, 7, and 8. Vertical leg 53 of bearing bracket 51 is supported on bearing plate 45 in a generally known manner so that it can be turned about a horizontal axis 67 and can be locked in two positions, 180° apart. This serves to reposition the fitting for a right or left limit stop. According to FIG. 8A, mounting plate 45 and vertical leg 53 of bearing bracket 51, abutting flush against the former's back side, are joined to each other by a rivet 69, so as to be able to rotate but not to separate. Rivet 69 has a multiple-step diameter, specifically a head 69*a*, a middle segment 69*b*, and a rivet end 69*c*. It is introduced, together with an elastomer spring washer 71 surrounding its middle part 69*b*, into correspondingly stepped bearing openings 73, 74, of vertical leg 53 of bearing bracket 51 and of mounting plate 45, and it is secured by flattening its rivet end 69*c*. Bearing opening 73 of vertical leg 53 has larger dimensions than head 69*a* of rivet 69, so that vertical leg 53 of bearing bracket 51 can be displaced relative to bearing plate 45 in a direction transverse to axis 67, in particular upwards, spring washer 71 being elastically deformed, as is shown in FIG. 8B. The bearing opening 73 in vertical leg 55 of bearing bracket 51, bearing opening 74 of mounting plate 45, rivet 69 passing through both bearing openings 73, 74, and washer 71 configure a turning bearing 120.

For securing bearing bracket 51 in the one or the other of its operational positions 180° apart, for the right or left limit stop, bearing plate 45 has at its upper and lower narrow sides, in each case, a locking notch 75, into which one of two locking projections 77 can engage, which protrude on the inner side of vertical leg 53 of bearing bracket 51. In front of each locking notch 75 of bearing plate 45, a rising guideway 79 is positioned. When bearing bracket 51 is turned about axis 67, locking projection 77, located in front in the direction of motion, is guided on guideway 79 such that the locking projection forces a transverse displacement of bearing bracket 51 relative to bearing plate 45, with the elastic deformation of spring washer 71, as indicated in FIG. 8B, until the respective locking projection 77 engages in locking notch 75, due to the elastic resiliency of spring washer 71, spring washer 71 as a result of its resiliency returning the parts to the concentric position with respect to turning axis 67 as indicated in FIG. 8. For releasing the latch, the user must exert by hand a force effecting the transverse displacement of bearing bracket 51 relative to bearing plate 45, in order to lift locking projection 77 out of locking notch 75. Subsequently, the parts can be turned until the other locking projection 77 runs up against the other guideway 79 and then engages in the manner described in the other locking notch 75. In this way, it is possible to effect the left-right repositioning of the fitting in the simplest way and without the assistance of a tool.

In the specific embodiment described, locking projections 77, as depicted, are configured hook shaped, so that they also grasp from behind the side of mounting plate 45 that is turned away from leg 53 of bearing bracket 51. In this way, the transmission of force between bearing bracket 51 and movable bearing part 39 of the hinge bearing is improved in the direction parallel to axis 67.

The fitting according to the present invention is so designed that support arm 11 (false shears arm) for a turning sash can be exchanged for a swing arm (shears arm) for a turning-tilting sash, without any changes having to be made in the other components of the fitting.

FIG. 9 indicates a representation similar to FIG. 2, support arm 11 of FIG. 2, however, being replaced by a conventional swing arm 7 of a turning-tilting fitting. This swing arm differs from support arm 11 in that over its entire length it runs above rabbet surface 19 of the sash frame and it has a turning pin 83, which is supported in a slot of the cuff bar (not depicted) of the sash, as well as a locking cam 85, which cooperates with a locking pin (not depicted) of the sash-side fitting, in order to rigidly fix swing arm 7 as desired for the turning opening at the sash, or to release it for the tilting opening for the pivot motion relative to the sash. The end of swing arm 7 facing hinge bearing 9 is configured so as to be fully analogous to support arm 11 as described in FIGS. 2 through 7, with the sole difference that leg 87, bent downwards at a right angle at the end of swing arm 7, is so short, tapped bore hole 61 for the engagement of adjustment screw 63 being located in leg 87, that leg 87 does not protrude into the rabbet groove of sash frame 3. An engagement of bent leg 87 in the rabbet groove of the sash frame would hinder the release of swing arm 7 for the tilting opening and would also make it impossible to place cuff bars, corner repositioning devices, or the like in the rabbet groove of the sash frame in the area of the bearing-side upper corner.

In this way, all of the parts of the fitting, with the exception of support arm 11 or swing arm 7, can be used without modification for a turning sash or a turning-tilting sash, so that the manufacture, storage, and processing of the fitting becomes quite significantly simpler.

A second specific embodiment of the invention is described on the basis of FIGS. 10 through 14. It differs from the embodiment described above in the configuration of bearing bracket 51, both in what concerns its connection with support arm 11 as well as its support on bearing plate 45. Support arm 11', depicted in FIG. 10, is configured so as to be essentially identical in its sash-side segment 15 and its bent segment 16 to support arm 11 in accordance with FIG. 2, and it is inserted and secured in the same manner as the latter in the cuff bar groove and connecting rod groove of sash frame 3. Sash-side segment 13' forms a guide segment of smaller width, in which a longitudinal slot 91 having a cross-shaped extension 91*a* is configured (see FIG. 13). Horizontal leg 57' of bearing bracket 51 is shaped as a U-guideway, open downwards, which movably accepts bearing-side segment 13' of support arm 11.

In the upper wall of horizontal leg 57', i.e., of the U-guideway, a guide opening 93 is configured (FIG. 13), in which a slide ring 95 is guided, which is penetrated by adjustment screw 65 mounted in vertical leg 53 of bearing bracket 51 and is in threaded engagement with the former, preferably via a thread cut by adjustment screw 65 configured to be self-tapping. Slide ring 95 on its upper end has two lateral projections 95*a*, which contact diagonal surfaces 93*a* of guide opening 93. The shank of glide ring 95, connected from below, has a cross-section such that it fills cross-shaped extension 91*a* of support arm 11' in a positive fit, so that support arm 11 is connected via glide ring 95, functioning as driver pin, to adjustment screw 65 and, by turning adjustment screw 65 can be shifted along the U-guideway in horizontal leg 57' of bearing bracket 71.

Glide ring 95 has a shank-like downwards extension and, underneath bearing-side segment 13' of support arm 11', supports a guide piece 97, which, as depicted in FIG. 10, with respect to the mounted fitting engages in rabbet surface groove 21 of the vertical rabbet surface of sash frame 3 (FIG. 10), specifically in its lower groove part 24 functioning as connecting rod groove. Guide piece 97 thus supports bearing bracket 51 and therefore bearing-side segment 13' of support arm 11' on sash frame 3 in opposition to forces acting perpendicular to the sash plane, but it is movable vertically in rabbet surface groove 21, so that bearing-side segment 13' of support arm 11' is not prevented from moving vertically relative to sash frame 3 and therefore from following a vertical displacement carried out at the corner bearing 5 (FIG. 1).

The support described of bearing-side end 13' of support arm 11' in the vertical rabbet surface groove is achieved without support arm 11' having at its end a leg bent at a right angle, as is the case in the specific embodiment according to FIGS. 2 through 10. Support arm 11' can be replaced by a conventional swing arm for a turning-tilting window, if the latter's bearing-side end is configured in the same way as was described for support arm 11 and depicted particularly in FIG. 13. When a swing arm is employed, guide piece 97 is omitted and a glide ring 95 is used, which is configured in the vertical direction to be significantly shorter, so that its shank does not extend into the area of the rabbet surface groove of the sash frame.

Glide ring 95 and guide piece 97 can be made of a suitable plastic.

Vertical leg 53 of bearing bracket 51 grips bearing plate 45 of movable bearing part 39 from behind and is mounted on bearing plate 45 in the same manner using rivet 69 and spring washer 71 so as to turn and be movable in a transverse direction in opposition to the spring force, as was described in the specific embodiment according to FIGS. 2 through 8. However, the cooperating locking projections and locking latches for fixing bearing bracket 51 in one of the two positions, 180° apart, relative to mounting plate 45 are differently configured than in the case of the previous specific embodiment. On vertical leg 53 of the bearing bracket, a single locking projection 78 is configured in the middle of the surface facing mounting plate 45, the locking projection being able to latch optionally in one of two matching openings 76, which are punched out in bearing plate 45 in the center and symmetrically above and below bearing opening 74 for rivet 69. In front of each locking opening 67, a guide groove 80, open to the free edge of mounting plate 45, is mounted, guide groove 80 supporting locking projection 78 of bearing bracket 51 and permitting it to latch into respective locking opening 76, with initially deformation and then relaxation of spring washer 71. Additionally, provision is made on bearing bracket 51 for hook-shaped support projections 89, which grip bearing plate 45 at its upper edge from behind and from above, as was described for hook-shaped locking projections 77 of the specific embodiment according to FIGS. 2 through 8.

A third specific embodiment is described on the basis of FIGS. 15 through 18. In it provision is made beneath support arm 11" for a filler 101, that is preferably made of plastic. Filler 101 is configured so that it can be inserted into upper horizontal rabbet surface groove 21 of sash frame 3 and that it fills up the groove to its deepest point. At the end facing hinge bearing 9, filler 101 has an angle bend 103, which engages in the vertical rabbet groove of sash frame 3. Sash-side segment 15 of support arm 11" is fixedly connected at a suitable location, which is designated in FIG. 15 as 105, to sash frame 3 using a screw (not depicted), which is screwed through bore holes of support arm 11' and of filler 101 in the base of rabbet groove 21. In this area, support arm 11" is preferably bent, as depicted, in the shape of a bend 107 running in a transverse direction, in order to improve its flexibility in the vertical direction. To the left of screw location 105, support arm 11" is configured in the same manner as support arm 11 according to FIG. 2 and is attached in the area of its U-shaped bent end 23 in the connecting rod groove using a further screw.

The part of support arm 11" situated to the right of screw location 105 and bend 107 is, due to its flexibility, vertically movable relative to sash frame 3 in particular in the area of bend 107 and bent segment 16, in order to be able to follow the adjustment movements of the sash that are effected at lower corner bearing 5 (FIG. 1). In this vertical motion, support arm 11" is guided by filler 101. For this purpose, filler 101 has on its upper side a guide projection 109, which penetrates a guide opening 111 of support arm 11". In its upper area, guide projection 109 is configured to be U-shaped, having two legs which have beveled locking projections 113 protruding to the outside. Upon being inserted into guide opening 111 of support arm 11", the U-legs of guide projection 109 are pressed together until the projections 113 lock into place behind the longitudinal edges of rectangular guide opening 111, so that filler 101 is permanently secured on support arm 11". Filler 101 has a second feed-through opening 115 for a second mounting screw, using which the filler can be secured to the base of rabbet groove 21. An access opening 117 in support arm 11" having appropriately large dimensions, permits access to this mounting screw.

Bearing-side segment 13 of support arm 11", bearing bracket 51, and hinge bearing 9 having movable bearing part 39 and support plate 45 are configured essentially identically as in the specific embodiment according to FIGS. 10 through 13, and for this reason will not be discussed once again in detail. It remains only to mention that slide ring 95', engaging in the extension 91*a* of slot 91 of support arm 11", is dimensioned in the vertical direction to be so short that it does not extend into the rabbet groove of sash frame 3 and also does not support a guide piece, such as guide piece 97 in FIG. 10. This is possible because slide ring 95 does not have any guide function for the vertical movement of support arm 11" since this guidance is taken on by guide projection 109 of filler 101. If, in place of support arm 11" for a turning sash, a swing arm for a turning-tilting sash (of course without filler 101) is to be connected to bearing bracket 51, slide ring 95 can therefore also be used unchanged and does not have to be exchanged for another slide ring.

What is claimed is:

1. A fitting for mounting a door or window sash on a frame, using a bearing secured to the frame, the bearing having a bearing part, rotatable about a vertical axis, the bearing part having a bearing plate, which is located in a rabbet space parallel to a vertical rabbet surface of the sash, an arm arranged in an upper horizontal rabbet space of the sash, the arm being a support arm, connected to the sash, for mounting a turning sash and a bearing bracket connecting the arm to the bearing, the bearing bracket having a horizontal leg forming a receptacle having an adjustment device for the end of the arm, and a vertical leg, which grips the bearing plate of the bearing part from behind and is rotatably mounted on the bearing plate through a turning bearing having a horizontal axis of rotation, in order to be able to rotate the bearing bracket through 180° for a right/left repositioning of the fitting, wherein the bearing bracket includes at least one locking projection and the bearing plate includes at least one locking recess, wherein said at least one locking projection cooperates with said at least one locking recess in order to fix the bearing bracket in at least one position, and the locking projection configured to force a transverse displacement of the bearing bracket relative to the bearing plate in order to engage and disengage the at least one locking projection and the at least one locking recess, characterized in that the turning bearing is configured so as to have spring elasticity in its radial direction in order to make possible the displacement of the bearing bracket relative to the bearing plate.

2. The fitting according to claim 1, wherein the turning bearing includes a spring washer that is elastically deformable in the radial direction, the spring washer engaging in the holes of the bearing bracket and of the bearing plate.

3. The fitting according to claim 2, wherein the bearing plate includes at least one guideway and the at least one locking recess and the bearing bracket includes at least one projection, which guides the rotation of the bearing bracket relative to the bearing plate so as to force a radial displacement of the bearing bracket relative to the bearing plate and ensures the engagement of the at least one projection into the at least one locking recess.

* * * * *